United States Patent [19]

Taketoshi et al.

[11] 4,451,241

[45] May 29, 1984

[54] METHOD OF MANUFACTURING A TV CAMERA TUBE

[75] Inventors: Kazuhisa Taketoshi; Chihaya Ogusu, both of Tokyo, Japan

[73] Assignee: Nippon Hoso Kyokai, Tokyo, Japan

[21] Appl. No.: 338,240

[22] Filed: Jan. 11, 1982

[30] Foreign Application Priority Data

Jan. 29, 1981 [JP] Japan ..... 56/10849

[51] Int. Cl.[3] ..... H01J 9/18

[52] U.S. Cl. ..... 445/33; 445/36; 445/47; 445/58; 427/125; 427/87; 313/377; 118/726

[58] Field of Search ..... 445/3, 29, 33, 36, 37, 445/58, 47; 427/77, 78, 74, 76, 87, 124, 125; 313/376, 377, 379; 118/726

[56] References Cited

U.S. PATENT DOCUMENTS

| | | | |
|---|---|---|---|
| 2,141,836 | 12/1938 | Farnsworth | 427/125 |
| 3,761,762 | 9/1973 | Henry | 313/377 |
| 4,222,345 | 9/1980 | Bergfelt | 427/124 |

FOREIGN PATENT DOCUMENTS

| | | | |
|---|---|---|---|
| 53-8044296 | 11/1978 | Japan | 313/376 |
| 54-6018340 | 6/1979 | Japan | 427/87 |
| 56-61745 | 5/1981 | Japan . | |

OTHER PUBLICATIONS

"Journal of the Institute of Television Engineers of Japan", vol. 19, No. 2, (1965) pp. 22–28.

*Primary Examiner*—Kenneth J. Ramsey
*Assistant Examiner*—Kurt Rowan
*Attorney, Agent, or Firm*—Spencer & Frank

[57] ABSTRACT

A method of manufacturing a camera tube having structure suitable for the HN system comprising a glass faceplate covered by an n-type transparent electrode layer consisting of, for instance, Nesa glass on which a thin $p^+$-type layer, a p-type layer and an n-type layer are deposited in succession to form a photoconductive layer on which a block layer is deposited to form a protected photoconductive target. A metal mesh covered by an insulation material and a collector electrode for collecting secondary electrons emitted from the target are arranged on the electron beam scanning side of the target.

10 Claims, 24 Drawing Figures

METHOD OF MANUFACTURING A TV CAMERA TUBE

BACKGROUND OF THE INVENTION

The present invention relates to a method of manufacturing a TV camera tube of the so-called HN type, that is, of the high-electron-beam-velocity scanning and negative charging type, particularly, a photoconductive type TV camera tube having a metal mesh and a collector electrode arranged on the electron beam scanning side of a negative-charged photoconductive target.

A TV camera tube of the HN type is disclosed by Miyashiro in a publication "TV camera tube having a negative-charged target scanned by a high speed beam", Television, Vol. 19, No. 2, 1965, pp 96–102.

Comparing this TV camera tube of the HN type and the conventional LP type, namely, of the low-electron-beam-velocity scanning and positive charging type, which has a positive-charged photoconductive target scanned by a low speed electron beam, the latter is operated at a low target voltage and a secondary electron emission ratio $\delta$ wich is less than unity, namely, $\delta<1$, so that scanning electrons land directly on the target. In other words, the scanning beam gives a negative charge to the target. As a result, a current of electrons is circulated in a direction from a cathode through the target and a signal electrode successively following which they are returned to the cathode.

On the other hand, in the TV camera tube of the HN type, which is quite different from that of the LP type, the target is scanned at a target voltage which is high enough to make $\delta>1$. As a result, secondary electrons emitted from the target by the scanning beam are collected by a collector mesh electrode to which is applied a voltage that is a few volts higher than that of the target. In this situation where $\delta>1$, the secondary electrons, which are more plentiful than the electrons of the scanning beam impinging on the target, are collected by the collector mesh electrode, so that the scanning beam gives a positive charge to the target. In other words, the current of electrons flows in a direction from the target to the signal electrode through the collector mesh electrode. Accordingly, the directions of the currents of electrons flowing through the targets in the LP and HN types are opposite to each other.

In connection therewith, it is confirmed that a TV camera tube of the HN type has the following advantages in comparison with that of the LP type:

(1) The capacitive discharge lag performance is better.

(2) The resolution is better.

(3) The energy of the scanning beam is higher, so that there is scarely any beam bending.

Therefore, there is demand for the development of a target which is suitable for a camera tube of the HN type, in other words, which is not appreciably damaged by a high speed electron beam having high energy and which is operated at the opposite polarity from that scanned by the low speed electron beam. However, such a target has not yet been realized and a method of manufacturing it has not yet been established, and further a suitable method for deriving a picture signal therefrom has not yet been developed.

The above situation is based on problems which may be enumerated as follows:

(1) Problems of the structures of the target and the camera tube (a) Problem of high speed beam blocking In a camera tube of the HN type, the energy of the high speed beam impinging on the target is larger than that of the LP type. Hence, if use is made of a target having a polarity opposite to that of the LP type by analogy to the LP type, the high speed beam penetrates through the target, and, as a result, the dark current is increased excessively so that this camera is not fit for use. Consequently, a target which has a high resistivity against the impact of a high speed beam is required.

(b) Problem of the shadow of the mesh collector

When the distance between the target and the mesh collector is increased to reduce the stray capacity between the target and ground, low speed secondary electrons emitted from a part of the target are deposited on the other part thereof, and, as a result, a spurious signal generated by redistribution is increased, so that the mesh collector must be placed close to the target. Consequently the stray capacity of the target is greatly increased. For instance, when the mesh collector is disposed adjacent to the target, the above-mentioned stray capacity of a one inch target amounts to 2000 pF. In addition, portions of the target which can not be scanned by the scanning beam, namely, portions corresponding to the so-called shadow of the mesh collector, are produced so that the picture signal cannot be derived from those portions of the target.

(c) Problem of the blocking of electron injection from the faceplate side

A transparent Nesa signal electrode formed of, for instance, $SnO_2$ has a strong n polarity. Accordingly, when a target polarity opposite to that of a target used for low speed beam scanning is formed on a surface of this Nesa electrode, by for instance, reversing the order of the layer structures, electrons are injected into the target from the signal electrode and, as a result, the dark current is increased. Thus, a layer structure is required in which the electron injection is obstructed.

(2) Problems relating to signal derivation

Signal derivation from a camera tube of the HN type has been tried in the following three modes, which will be described hereinafter regarding difficulties caused by those conventional modes of signal derivation.

(a) T mode

For deriving the picture signal from a target similar to that used in the conventional LP type, a preamplifier is arranged between the signal electrode and the target voltage source. In this T mode, reduction of the spurious signal by redistribution requires that the distance between the target and the mesh collector be greatly narrowed. Accordingly, as mentioned above, the stray capacity of the target is greatly increased, so that it amounts usually to 2000 pF. This stray capacity is coupled with the preamplifier in parallel, so that the resolution and the SN ratio are greatly lowered.

(b) M mode

For deriving the picture signal from a mesh collector, the preamplifier is connected between the mesh collector and the connection point of the target voltage source and the collector voltage source. In this M mode, the following defects are added to the above-mentioned defects of the T mode. That is, the current flowing into the mesh collector in response to the beam scanning, which amounts usually to 1 $\mu$A, is added to the signal current, so that the beam noise caused by the ineffectual beam having no relation to the signal is increased.

(c) RB mode

Corresponding to the return beam mode in a camera tube of the LP type, secondary electrons passing through the mesh electrode are collected by the collector electrode arranged between the mesh electrode and the cathode, and then the signal corresponding to those electrons collected by the collector electrode is derived by the preamplifier arranged between the collector electrode and the connection point of the mesh voltage source and the collector voltage source. The mesh electrode is provided for keeping the balance of the beam scanning side surface potential of the target, so that it will be called hereinafter a balancing mesh, and the simple term of "mesh" will mean this balancing mesh. Moreover, the above described collector electrode means all such electrodes as can be practically formed by applying a voltage which is a little higher than the mesh voltage to those electrodes which are usually called collectively the "$G_3$ electrode" or "$G_2$ electrode" and used for focusing or accelerating the electron beam. In this RB mode, the signal is derived from the collector electrode, so that the large stray capacity between the mesh and the target is allowable. However, this RB mode has also a defect such that the secondary electrons passing through the mesh are deposited thereon and the amount of those deposited electrons corresponds nearly to the light transparency, that is, about 50 percent, and, as a result, the signal current is decreased. Moreover, other secondary electrons, which are emitted from the mesh with no relation to the signal, are added to those secondary electrons which are emitted from the target and hence correspond to the signal, whereby the beam noise is increased.

In the RB mode of a camera tube of the HN type, wjich is quite different from that of a camera tube of the LP type, the potential of the surface of the target, which surface is exposed to the beam scanning is nearly equal to that of the mesh and further the space distance between the target and the mesh is also extemely close, so that it is almost impossible to separate those secondary electrons emitted rom the mesh from the secondary electrons emitted from the target.

SUMMARY OF THE INVENTION

An object of the present invention is to provide a method of manufacturing a TV camera tube having such a target structure and such a mesh structure that a camera tube of the HN type can be applied for practical use as the result of resolving the aforesaid various problems.

As a part of attaining the above object, the present invention provides a TV camera tube which comprises an n-type transparent signal electrode layer consisting, for instance, of Nesa glass which layer is deposited on a glass face plate, a target formed of a photoconductive layer disposed on the above signal electrode layer by depositing a thin $p^+$-type layer, a p-type layer and an n-type layer thereon in order and a block layer deposited on the photoconductive layer and further a metal mesh and a collector electrode arranged on the beam scanning side of the target.

In such a camera tube, in order that the target can endure the impact of the electron beam, the target is provided with the block layer, and the photoconductive layer proper is formed in the p-n structure having a polarity which is reversed from that of the conventional structure. As a result, the electron beam impinging on the surface of the block layer at high speed causes secondary electrons to be emitted therefrom and then goes towards the photoconductive layer. Consequently, the block layer converts the energy of the high speed beam into thermal energy, which is conducted to the glass faceplate from the photoconductive layer to the transparent signal electrode layer without harming the target and is radiated outside thereof. The velocity of the incoming electron beam approaches zero when it arrives at the surface of the photoconductive layer through the block layer.

It is preferable for operating such a camera tube that the target is operated according to the HN system, and that the output signal is derived in response to the secondary electron emission therefrom. However, it is required to form the block layer of a material such that sufficient secondary electrons can be emitted therefrom and a high heat conductivity can be obtained.

In order to reduce the spurious signal by redistribution, the target and the metal mesh are disposed close to each other, so that the stray capacitance is increased. However, the lowered SN ratio resulting therefrom cannot be improved structurally, so that it is necessary to derive the signal appropriately to prevent the SN ratio from being lowered.

Besides, in order to resolve the aforesaid problem of the shadow of the metal mesh, a current is also caused to flow in portions of the block layer which portions are shadowed by the metal mesh by the leakage based on the appropriately selected resistance of the block layer, so as to derive signal components in response to secondary electrons emitted from the above-mentioned shadowed portions of the block layer.

In the camera tube mentioned above, the photoconductive layer has a layer structure of reverse polarity to that of the conventional photoconductive layer, so that a $p^+$-type transparent signal electrode, instead of the conventional n-type transparent electrode is provided, that is, the so-called Nesa film can be deposited on the glass faceplate. However, no appropriate $p^+$-type transparent electrode has yet been developed, so that the conventional n-type Nesa film is employed for the transparent electrode, and further a $p^+$-type thin layer is arranged between the Nesa film and the photoconductive layer. This layer structure can be realized by the manufacturing method disclosed in U.S. patent application Ser. No. 213,016, now U.S. Pat. No. 4,352,834 KCR. Next, the manner of deriving signals by using the above-described camera tube will be explained. As mentioned earlier, regarding the T mode, when the distance between the target and the metal mesh is made short in order to reduce the spurious signal by redistribution, there is an extreme decrease in the resolution and the SN ratio, whilst, regarding the RB mode, although such an increased stray capacitance as mentioned above is allowable, as other defects, the loss of the signal current is increased, and hence the beam noise is also increased, and further two kinds of secondary electrons emitted respectively from the metal mesh and the target cannot be separated.

In order to resolve the above-mentioned problems, it is preferable to derive the picture signal from a camera tube of the HN type having an extremely short distance between the target and the metal mesh as mentioned above by a combination of the T mode and the RB mode, as as to cancel the above-mentioned respective defects of each of the modes.

In order to manufacture a camera tube having such a structure as mentioned above, according to the present invention, a metal mesh is heated at a temperature in a range from 80° to 400° C., and the thus heated metal mesh is rotated around a rotation axis which is perpendicular to a surface of the metal mesh at a rate of one revolution per one to ten seconds, and, in this state of rotation, an insulation material is evaporated on the surface of the rotating metal mesh from an evaporating source arranged above the metal mesh at an angle of 20 to 70 degrees to form an insulated metal mesh. The completely insulated mesh surface is arranged to face the target.

With the above-described structure, secondary electrons emitted from the target are not collected by the metal mesh, but by the collector electrode. The insulated metal mesh can be arranged in the vicinity or on the block layer of the target.

SiO, $MgF_2$ or $Y_2O_3$ is preferable for the insulation material to cover the metal mesh, and it is preferable to set the thickness of the insulation material film in a range from 1000 Å to 5 μm. If this thickness is less than 1000 Å, the insulation is not sufficient, and the metal mesh is easily clogged if the thickness is more than 5 μm. In addition, the evaporated insulation material extends behind the metal mesh, and consequently the rear surface of the mesh facing the target is also covered by the insulation material. Thus, it is also preferable to deposit a gold film on this rear surface to prevent an irregular variation of the mesh potential in different portions of the metal mesh. For this purpose, after the above evaporation of the insulation material, for instance, a gold film having a thickness in a range from 30 Å to 300 Å is deposited on the rear surface of the metal mesh which is not yet sufficiently covered by the insulation material by the evaporating source arranged vertically above the metal mesh. When the thickness of the gold film is less than 30 Å, conductivity is insufficient, whereas particles of gold easily reach behind the metal mesh, if the thickness is more than 300 Å. In addition, it is also preferable to deposit an insulation film having a thickness in a range from 150 Å to 2000 Å on the surface of the metal mesh, which has been completely covered by the insulation material, from the evaporating source arranged just above the metal mesh after the deposition of gold on the rear surface of the mesh. This process is performed to cover the gold particles deposited on the side surfaces and the surface covered by insulation material of the metal mesh. If the thickness of the insulation material covering the gold particles is less than 150 Å, the insulation of the surface is insufficient. If the thickness is more than 2000 Å, there is a tendency for the insulation material to reach the surface on which the gold is covered to cover this gold-deposited surface.

Further, it is also preferable that an insulation film having a predetermined thickness for determining the distance between the block layer and the metal mesh be formed by evaporation on at least one of the block layer and the metal mesh. SiO, $MgF_2$, $Y_2O_3$ or the like may be employed for the material of this insulation film. The predetermined thickness is preferably determined in a range from 0.5 μm to 5 μm.

In a preferred embodiment of the present invention, the n-type transparent electrode consists of a Nesa film, the $p^+$-type layer is formed of CdTe, the p-type layer is formed of CdTe, the n-type layer is formed of CdS, and the block layer is formed of CdTe, ZnTe or a solid solution thereof. However, if conventional evaporating sources are employed for evaporating these materials, vacuum evaporated powders thereof are scattered at the time of heating because of sublimation of powders of these materials and hence are deposited on the target in a powder condition and as a result the camera plane has a defect. In view of this, according to the present invention, it is preferable that the evaporation materials are accommodated in a conical vessel of nichrome, Kovar, tantalum, nickel or the like, an inner surface of which is heat-insulated by a film of alumina, magnesia, zirconia or the like. The evaporation material is covered by a heat-resistive filter formed of quartz cotton or tungsten mesh. The evaporation material is heated by a tungsten heater disposed above the filter without scattering evaporation material. According to this embodiment, the heat loss is reduced since the supporting vessel is heat-insulated, and gas is hardly produced from jigs during the heating and thus the target can be manufactured with good reproducibility.

In a preferred embodiment of the present invention, the camera tube is assembled as follows. First, buried in the glass faceplate is a pin which is electrically connected to the Nesa glass. A $G_4$ electrode of a conventional electron gun is used as a collector electrode. A mesh rack is disposed on the $G_4$ electrode. A skirted Teflon ring having a thickness in a range from 0.1 mm to 0.8 mm covers the mesh rack. The metal mesh is disposed on the Teflon ring. In addition, an indium ring is disposed on an opening end of a glass envelope surrounding the $G_4$ electrode. The peripheral portion of the glass faceplate belonging to the block consisting of the glass plate, the Nesa glass and the target is disposed on or opposite to the indium ring so that the block is opposite to the metal mesh. A faceplate holder is disposed on the glass faceplate via a conductive rubber sheet for absorbing and unifying the impact caused by pressing the faceplate holder. A capacitance meter is connected between the rubber sheet and the indium ring, so that the capacitance between the indium ring and the metal mesh is measured by the meter while maintaining the electrical connection between the rubber sheet and the above-mentioned pin. While measuring the capacitance, the faceplate holder is pushed down to press the glass faceplate towards the metal mesh to crush the indium ring. When the capacitance measured by the capacitance meter is suddenly increased, the faceplate holder is stopped from being pushed further and then the vacuum sealing of the glass envelope is completed. As a result, the contact between the inner surface of the crushed indium ring and the metal mesh is completed.

BRIEF DESCRIPTION OF THE DRAWINGS

For a better understanding of the invention, reference is made to the accompanying drawings, in which.

DETAILED DESCRIPTION OF THE PREFERRED EMBODIMENTS

As mentioned earlier, it has been confirmed that a TV camera tube of the HN type has various advantages in comparison with that of the LP type. However, various problems regarding the structure of the target and other elements, and regarding the signal derivation thereof remain, and hence a target suitable for the HN system has not yet been realized, no manufacturing method has yet been established and no signal derivation suitable for the HN system has been sufficiently developed.

First, the differences between a camera tube of the HN type and that of the LP type will be described by referring to FIGS. 1 and 2.

Figure 1:
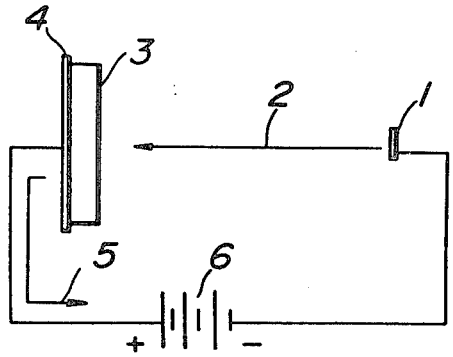
PRIOR ART FIG. 1
FIG. 1 is a circuit diagram showing an outline of a conventional TV camera tube of the LP type.

In a camera tube of the LP type as shown in FIG. 1, 1 is a cathode, 2 is a scanning beam injected from the cathode toward a target 3, 4 is a Nesa transparent signal electrode consisting, for instance, of $SnO_2$, which is deposited on the target 3, 5 is an electron current derived from the signal electrode 4, and 6 is a target voltage source applying a positive voltage to the target 3. In the LP system, the target voltage is lowered, and hence the target 3 is operated with a secondary electron emission ratio $\delta$ which is less than unity, namely, $\delta<1$, so that electrons of the scanning beam 2 land directly on the target 3, and hence the scanning beam 2 gives negative charges to the target 3. Accordingly, as shown in FIG. 1, electrons flow in a direction from cathode 1 through target 3 and the signal electrode 4 from which they return to the cathode 1, in this sequence.

Figure 2:
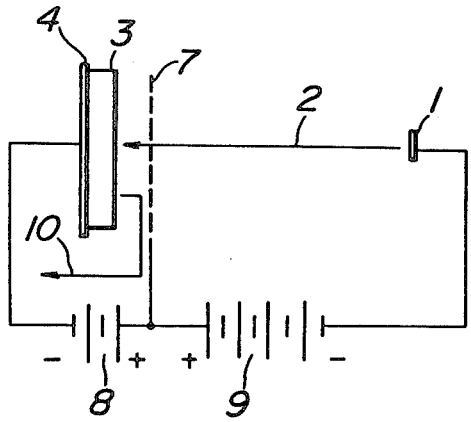
FIG. 2 is a circuit diagram showing an outline of a conventional TV camera tube of the HN type.

On the other hand, in a camera tube of the HN type as shown in FIG. 2, a collector electrode 7 formed of a mesh or the like, which is called a collector mesh, is arranged between the cathode 1 and the target 3. A target voltage source 8 which applies a negative voltage to the target 3 is connected between the signal electrode 4 and the collector electrode 7, and a collector voltage source 9 which applies a positive voltage to the collector electrode 7 is connected between the cathode 1 and the collector electrode 7. In the HN system, which is quite different from the LP system, the target 3 is scanned under the target voltage which is raised so high that $\delta>1$. As a result, the secondary electrons emitted from the target 3 by the scanning beam 2 are collected by the collector electrode 7 which has a voltage applied thereto which is a few volts higher than that of the target 3. In this situation, $\delta>1$, so that secondary electrons, which are more plentiful than those of the primary scanning beam 2 impacting the target 3, are collected by the collector mesh 7, and, as a result, the scanning beam 2 gives positive charges to the target 3. Accordingly, electrons flow in a direction from the target 3 to the signal electrode 4 through the collector mesh 7 as shown by the arrow 10 in FIG. 2, and hence, as is apparent from a comparison with FIG. 1, the directions in which the electrons pass through the targets 3 are opposite to each other in the LP and HN types of camera tubes.

It is confirmed that a TV camera tube of the HN type has the following advantages in comparison with tubes of the LP type:

(1) The capacitive discharge lag performance is better.

(2) The resolution performance is better.

(3) The energy of the scanning beam is higher, so that there is scarely any beam bending.

Therefore, there is demand for the development of a target which is suitable for the camera tube of the HN type, in other words, which is not appreciably damaged by a high speed electron beam having high energy and is operated at the opposite polarity from that scanned by the low speed electron beam. However, such a target has not yet been realized and a method of manufacturing it has not yet been established and further a suitable method for deriving a picture signal therefrom has not yet been developed.

The above situation is based on problems which may be enumerated as follows:

(1) Problems of the structures of the target and the camera tube (a) Problem of high speed beam blocking In a camera tube of the HN type, the energy of the high speed beam 2 impinging on the target 3 is larger than that of the LP type, so that, when the target 3 is operated at the opposite polarity to that of the LP type by a simple analogy thereto, the high speed beam 2 penetrates through the target 3, and, as a result, the dark current is increased excessively so that it is not fit for use. Consequently, a target which has a high resistivity against the impact of the high speed beam is required.

(b) Problem of the shadow of the mesh collector

When the distance between the target 3 and the mesh collector 7 is increased to reduce the stray capacity between the target 3 and ground, low speed secondary electrons emitted from a part of the target 3 are deposited on the other part thereof, and, as a result, a spurious signal generated by redistribution is increased, so that the mesh collector 7 must be arranged close to the target 3. Consequently, the stray capacitance of the target 3 is greatly increased. For instance, when the mesh collector 7 is disposed adjacent to the target 3, the stray capacitance of a one inch target 3 amounts to 2000 pF. In addition, portions of the target 3 which portions can not be scanned by the scanning beam, namely portions corresponding to the so-called shadow of the mesh collector 7, are produced, so that the picture signal cannot be derived from those portions of the target 3.

(c) Problem of the blocking of electron injection from the faceplate side.

The transparent Nesa signal electrode 4 formed of, for instance, $SnO_2$ has a strong n polarity. Accordingly, when a target having an opposite polarity from that used for low speed beam scanning is formed on a surface of the Nesa electrode 4, for instance, such as the order of those layer structures is reversed, electrons are injected into the target 3, and, as a result, the dark current is increased. Thus, a layer structure for blocking the electron injection is required.

(2) Problems relating to the signal derivation

The signal derivation from a camera tube of the HN type has been tried in the following three modes, which will be described hereinafter regarding difficulties caused by those conventional modes of signal derivation by referring to FIGS. 3 to 5.

(a) T mode

Figure 3:
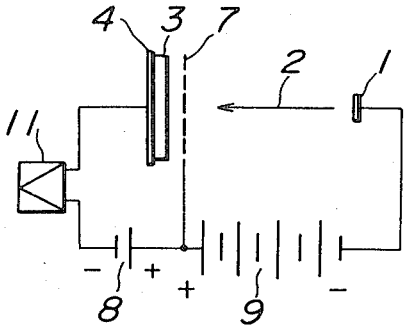
FIGS. 3 to 5 are circuit diagrams showing respectively various modes of signal derivation of the conventional TV camera tube of the HN type.
Figure 4:
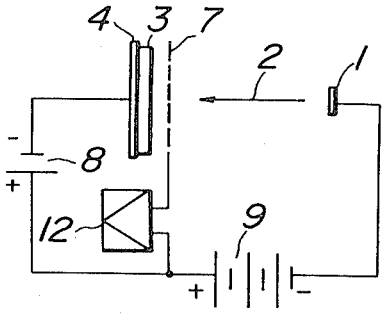

For deriving the picure signal from the target 3 in a manner similar to that used in the conventional LP type, as shown in FIG. 3, a preamplifier 11 is arranged between the signal electrode 4 and the target voltage source 8. In this T mode, in order to reduce the spurious signal by redistribution it is necessary to greatly narrow the distance between the target 3 and the mesh collector 7. Accordingly, as mentioned above, the stray capacitance of the target 3 is greatly increased, so that it amounts usually to 2000 pF. This stray capacitance is coupled in parallel with the preamplifier 11, so that the resolution and the SN ratio are lowered considerably (b) M mode For deriving the picture signal from the mesh collector 7, as shown in FIG. 4, a preamplifier 12 is connected between the mesh collector 7 and the connection point of the voltage sources 8 and 9. In this M mode, the following defects are added to the above-mentioned defects of the T mode. That is, the current flowing into the mesh collector 7 in response to the beam scanning, which amounts usually to 1 $\mu$A, is added to the signal current, so that the beam noise caused by the ineffectual beam having no relation to the signal is increased.

(c) RB mode

Figure 5:
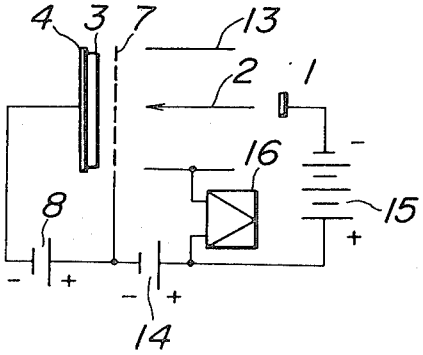

Similarly to the return beam mode in a camera tube of the LP type, as shown in FIG. 5, secondary electrons passing through the mesh electrode 7 are collected by a collector electrode 13 arranged between the mesh electrode 7 and the cathode 1, and then the signal corresponding to those electrons collected by the collector electrode 13 is derived by a preamplifier 16 arranged between the collector electrode 13 and the connection point of a mesh voltage source 14 and a collector voltage source 15. The mesh electrode 7 is provided for keeping the balance of the beam scanning side surface potential of the target 3, so that it is called a balancing mesh, and the simple description of "mesh" means this balancing mesh, as mentioned earlier. Moreover, the above described collector electrode means all such electrodes as can be practically formed by applying a voltage which is a little higher than the mesh voltage to those electrodes which are usually called collectively the "$G_3$ electrode" or "$G_2$ electrode" and used for focusing or accelerating the electron beam.

In this RB mode, the signal is derived from the collector electrode 13, so that the large stray capacitance between the mesh 7 and the target 3 is allowable. However, this RB mode has a defect in that secondary electrons passing through the mesh 7 are deposited thereon and the amount of those deposited electrons corresponds nearly to the light transparency, that is, about 50 percent, and, as a result, the signal current is decreased. Moreover, other secondary electrons, which are emitted from the mesh 7 with no relation to the signal, are added to those secondary electrons which are emitted from the target 3 and hence correspond to the signal, whereby the beam noise is increased.

In the RB mode of a camera tube of the HN type, which is quite different from that of a camera tube of the LP type, the potential of the surface of the target 3, which surface is exposed to the scanning beam 2 is nearly equal to that of the mesh 7 and further the space distance between the target 3 and the mesh 7 is also extremely close, so that it is almost impossible to separate those secondary electrons emitted from the mesh 7 from the secondary electrons emitted from the target 3.

Figure 6:
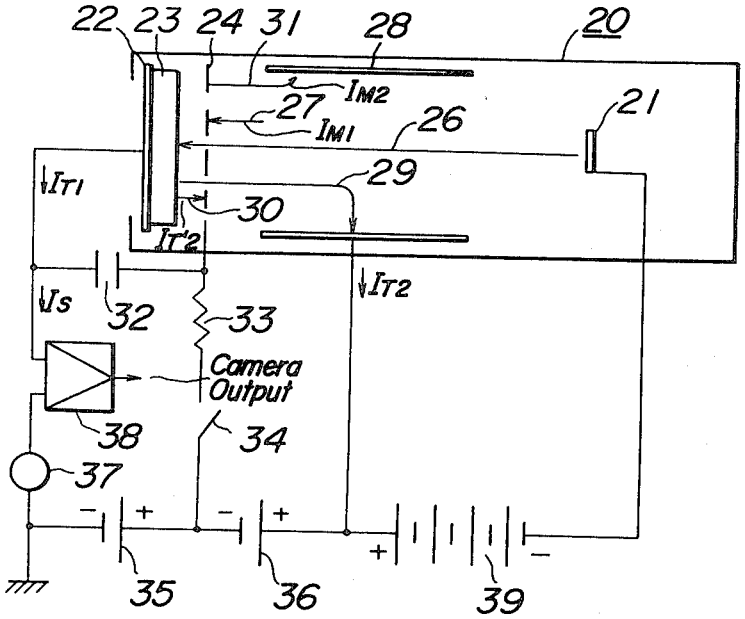
FIG. 6 is a circuit diagram showing an outline and a mode of signal derivation of a TV camera tube manufactured according to the present invention.

The present invention provides a method of manufacturing a TV camera tube having such a target structure and such a mesh structure as is provided in the HN system and which can be applied for practical use by resolving the above-mentioned various problems thereof. FIG. 6 shows the basic configuration of a TV camera tube manufactured according to the present invention together with the circuit for deriving the output signal and driving the camera tube.

In FIG. 6, 20 denotes the entire camera tube structure, 21 is a cathode, 22 is a signal deriving electrode consisting of a transparent electrode formed, for instance, of Nesa film, 23 is a target formed on the transparent electrode 22, and 24 is a metal mesh arranged close or adjacent to the target 23 so as to prevent the generation of the redistributed signal.

Figure 7:
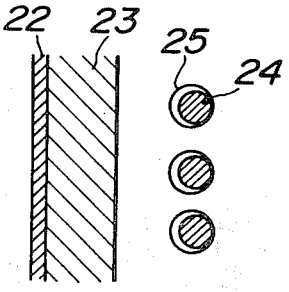
FIG. 7 is an enlarged cross-sectional view showing partially a target and a mesh of the TV camera tube.

As shown in FIG. 7, the metal mesh 24 is covered by an insulation material 25 deposited on a side thereof facing the target 23, so as to prevent an electrical connection between the metal mesh 24 and the target 23. The surface of the metal mesh 24 on the other side facing the cathode 21 is not covered by the insulation material 25, so as to maintain the mesh potential at a substantially constant level by injecting a part 27 of the electron beam 26 into the metal mesh 24 during beam scanning. A collector electrode 28 is arranged between the metal mesh 24 and the cathode 21, so as to collect secondary electrons 29 emitted from the target 23 by the scanning beam 26. The major part of the secondary electrons 29 is passed through the metal mesh 24 and then is collected by the collector electrode 28, and the minor part 30 thereof is collected by the metal mesh 24. On the other hand, secondary electrons 31 emitted from the metal mesh 24 by the injected primary scanning beam 27 are collected also by the collector electrode 28. The collector electrode 28 can be used in common as the beam collecting electrode, the beam accelerating electrode and the like, which are usually called as $G_4$, $G_3$, and $G_2$, respectively, for instance, when an electron gun available on the market is utilized. In this configuration of the camera tube, the metal mesh 24 and the collector electrode 28 are insulated from each other within the camera tube 20, and the metal mesh 24 and the target 23 are also insulated from each other within the camera tube 20.

Next, the camera circuit for driving the above-mentioned camera tube 20 will be described by referring to FIG. 6. In FIG. 6, a capacitor 32 having a large capacitance of, for instance, 1000 pF to 0.1 $\mu$F is connected between the metal mesh 24 and the target 23 through the signal electrode 22, whereby the mesh potential is maintained at a substantially constant level, and further the metal mesh 24 is connected to an end of a series circuit consisting of a resistor 33 having a high resistance which is sufficiently larger than the input impedance of the preamplifier 38, for instance, larger than 1

MΩ and a switch 34 which is opened only during the blanking period of the scanning beam and is closed when the scanning beam is scanning the mesh 24 and the target 23. The other end of the series circuit is connected to the connection point between the positive terminal of a target voltage source 35 of a voltage $V_T$ for charging the target 23 at a negative potential and the negative terminal of a mesh voltage source 36 of a voltage $V_M$ for charging the collector electrode 28 at a more positive voltage than the metal mesh 24. The negative terminal of the target voltage source 35 is connected to ground, as well as connected to the signal electrode 22 through a dc current meter 37 inserted for measuring the amount of de signal current $I_S$ and the preamplfier 38 used for deriving the output signal. The above-mentioned high-valved resistor 35 is used for preventing deterioration of the SN ratio of the output signal which would be caused by the parallel connection of the preamplifier 38 and the large capacitor 32. In order to prevent the breakdown of the insulation between the mesh 24 and the target 23 which is caused by the surge voltage, the cathode 21 is not grounded, but the voltage source 35 thereof is grounded. It is preferable to set the voltage of the target voltage source 35 in a range between zero and several tens of volts, and it is also preferable to set the voltage of the mesh voltage source 36 in a range between 10 volts and 50 volts. The positive terminal of the mesh voltage source 36 is connected to the collector electrode 28. A dc high voltage source 39 in a range between 300 volts and 1000 volts is connected between the collector electrode 28 and the cathode 21. The voltage of this voltage source 39 is set as high as possible so that the value δ of the target 23 becomes more than unity, and it is preferable to set the above voltage, for instance, at a value near 800 volts for improving the resolution performance.

Next, the operation of the camera tube and the camera circuit shown in FIG. 6 will be described.

As shown in FIG. 6, among the primary scanning beams 26 and 27, a part 30 of the secondary electrons generated by the beam 26 injected into the target 23, that is, the current $I_{TI}$, flows into the metal mesh 24 as a current $I_{T'2}$, whilst the metal mesh 24 is covered by the insulation material 25 except the side thereof scanned by the scanning beam as shown in FIG. 7, so that the major part of the secondary electrons emitted from the target 23 arrives at the collector electrode 28, to which is applied a voltage that is more positive than that of the metal mesh 24, through the metal mesh 24, and is derived therefrom as the current $I_{T2}$. As mentioned above, the following electron current $I_s$ flows through the preamplifier 38 and the dc current meter 37;

$$I_S = I_{TI} - I_{T2} + \alpha,$$

where α is a component consisting of a dc current leaking to the signal electrode 22 through the resistor 33, which dc current is the remaining part of the secondary electrons $I_{T'2}$ collected by the mesh 24 and discharged by the capacitor 32. In the present invention, the current $I_{T'2}$ can be set at less than 3% of the sum of the secondary electrons by applying the insulation processing to the mesh 24, so that α can be set further less than the amount $I_{T'2}$, and hence there is little loss of the output singal in the RB mode as mentioned above. In other words, the major part of the secondary electrons $I_{T2}$ can be collected by the collector electrode 28 without any loss. Since the electron current $I_s$ is generated by discharging the electric charge of accumulated light signals, it is no more than the signal current. In other words, almost all of the electron current flows through the preamplifier 38 and the dc current meter 37. Furthermore, the distance between the metal mesh 24 and the collector electrode 28 can be increased as much as possible, the stray capacitance therebetween can be reduced, for instance, to a value less than 1 pF. Accordingly, in the camera circuit, the deterioration of the SN ratio based on the stray capacitance does not occur at all. On the other hand, the distance between the mesh 24 and the signal electrode 22 is extremely short, and hence the capacitance therebetween becomes 2000 pF in the case of a one inch type camera tube, and further the capacitor 32 having a large capacitance is coupled with the external circuit. However, these capacitors are connected with the preamplifier 38 in series through the resistor 33, and hence are not directly connected therewith in parallel, so that deterioration of the SN ratio is slight.

In addition, the signal deriving circuit as shown in FIG. 6 is operated substantially in the T mode in which the preamplfier is inserted on the side of the target, so that, as is different from the M mode or the RB mode, the preamplifier 38 and the dc current meter 37 are not supplied with a current consisting of the difference between the current $I_{M1}$ which flows into the mesh 24 due to the scanning beam 27 to the mesh 24 and the current $I_{M2}$ consisting of the secondary electrons 31 emitted from the metal mesh 24 by the scanning beam 27. Accordingly, the preamplifier 38 is supplied only with the signal current, and hence there is no deterioration of the SN ratio. Moreover, in the camera tube constructed as shown in FIG. 6, the space between the mesh 24 and the target 23 can be made as narrow as possible so that the spurious signal can be thoroughly removed by redistribution accompanied with the high speed scanning.

Here, the selection of the capacitance C of the capacitor 32 and the resistance R of the resistor 33 will be described. It is preferable to select the time constant CR thereof by consideration of the maintenance of the constant mesh potential and the input impedance of the preamplifier. It is generally suitable to set the time constant CR larger than 1/30 second. When the time constant CR is smaller than 1/30 second, a microphonic noise is easily caused. The reason thereof is that the mesh potential is varied in response to the variation of the current $I_{T'2}$ flowing into the mesh 24, and, as a result, the coulomb absorbing force between the mesh 24 and the signal electrode 22 is locally varied. For practically selecting the time constant CR, first, the resistance R should be set sufficiently larger than the input impedance of the preamplifier 38. For example, when the input impedance of the preamplifier 38 is 4 MΩ, it is suitable to set the resistance R at 20 MΩ. In this case, it is desirable to set the capacitance C at more than 1200 pF under the condition of $CR > 1/30$ second. By the way, the microphonic noise appears usually in the form of lateral stripes in the reproduced picture. The practical cause thereof is not yet clear. However, it is at least clear that all of the microphonic noise can be prevented by selecting the time constant CR to a value larger than 1/30 second.

In FIG. 6, in the situation where the scanning beam is operated, the voltage applied to the capacitor 32 is the sum of the voltage $V_T$ of the voltage source 35 and the voltage $\Delta V=(I_{M2}-I_{M1})$ R based on the mesh current $(I_{M2}-I_{M1})$ flowing through the resistor 33. That is, the capacitor 32 is applied with the voltage $V_T$ which is fixed regardless of the on, off state of the scanning beam and the voltage $\Delta V$ which is generated only by supplying the beam current.

In the blanking period during which the scanning beam is in the off state, the preamplifier 38 is supplied with the discharge current caused by the voltage $\Delta V$. As a result of the experiment, this discharge current amounts to 1 $\mu$A. Next, when the scanning beam is in the on state, the capacitor is charged again by the amount of electric charges discharged in the off state. As mentioned above, the preamplifier 38 is supplied with the discharge current in response to the on-off state of the scanning beam. According thereto, the clamp level is varied, and hence the black level of the output picture signal is remarkably varied. These charge and discharge currents do not cause only variation of the clamp level but also deterioration of the SN ratio, so that it is required to remove these charge and discharge currents.

Figure 8:
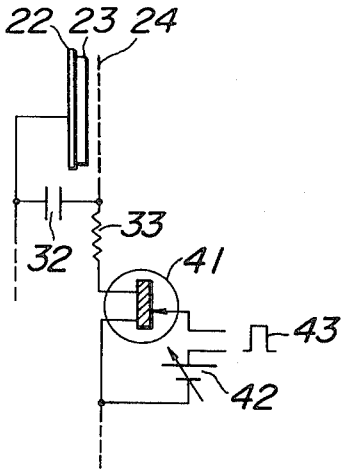
FIGS. 8 to 12 are circuit diagrams showing various examples of switching circuit shown in FIG. 6.
Figure 9:
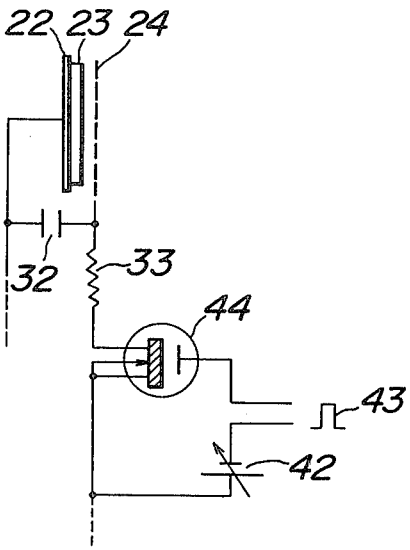
Figure 10:
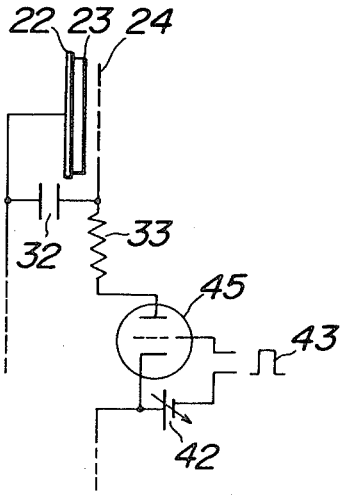
Figure 11:
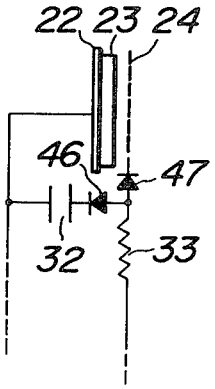
Figure 12:
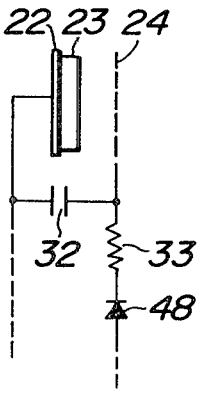

In view of the above, the camera circuit as shown in FIG. 6 has a switch 34, which is closed during the beam scanning, and is opened during the blanking period. This switch 34 can be formed, as shown in FIGS. 8 to 12, for instance, of a field effect transistor, a MOS type field effect transistor, a vacuum tube, a diode or the like. In FIG. 8, the switch 34 is formed of a field effect transistor 41, between a gate and a source of which a clamping pulse 43 generated in synchronism with the beam blanking is applied through a bias voltage source 42. A current path between the source and the drain of the transistor 41 is closed and opened under the control of the clamping pulse 43 corresponding to the on-off state of the scanning beam. An example shown in FIG. 9 is the same as in FIG. 8 except that the field effect transistor 41 is replaced with a MOS type field effect transistor 44. An example shown in FIG. 10 is the same as in FIG. 9 except that the MOS type field effect transistor 44 is replaced by a vacuum tube 45. In this example, the clamping pulse 43 is applied between a grid and a cathode of the vacuum tube 45 so as to control the on-off state therebetween. In FIG. 11, diodes 46 and 47 are connected between the capacitor 32 and the mesh 24, so as to block the discharge of the capacitor 32 in the off state of the scanning beam. In FIG. 12, this blocking of the discharge is effected by a diode 48 connected at the position of the switch 34 as shown in FIG. 6. The switch 34, which is formed in various configurations as mentioned above, is closed only during the beam scanning, and opened for the remaining duration, whereby supply of the preamplifier 38 with the discharge current generated by the variation of the potential of the capacitor 32 can be prevented and hence the black level during clamping can be maintained at a constant level.

Next, the detailed layer structure of the target in the camera tube will be described by referring to FIG. 13.

The target can be formed substantially of arbitrary material so far as it is provided with a layer structure having a reverse polarity in comparison with that of a camera tube of the LP type. However, in a camera tube of the HN type, which is quite different from that of the LP type, the target is always impacted by the high energy electron beam, so that it is preferable to form the target of such material as can withstand the electron beam impact such as semiconductors consisting of compounds of groups II and IV, for instance, CdTe-CdS. Accordingly, a target of the HN type can be formed by depositing CdTe and CdS in order on the transparent electrode consisting of a Nesa film or the like. However, the Nesa film has the polarity of $n^+$, and hence it becomes of the electron injection type to CdTe in the above layer structure, so that the above layer structure has a defect in that the dark current is increased. Furthermore, the high speed electron beam is employed for scanning the target, so that the above layer structure has the further defect that the scanning beam passing through the CdS layer and the CdTe layer successively flows into the signal electrode as a dark current.

Figure 13:
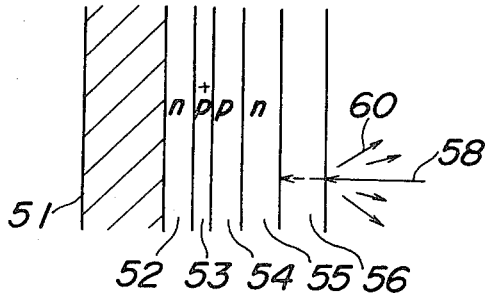
FIG. 13 is a partial cross-sectional view showing an example of the structure of the target shown in FIG. 6.

According to the present invention, the abovementioned defects are removed to form a target structure which fits the HN system as shown in FIG. 13.

In FIG. 13, 51 is a glass faceplate, and a Nesa film 52 is formed on the faceplate 51, for instance, by the chemical vapor deposition method, namely, so-called CVD method. This Nesa film 52 is deoxidized for about ten minutes, in a manner-similar to that disclosed previously by the inventor, by heating it at about 250° C. in a hydrogen atmosphere having a partial hydrogen pressure of $1\times10^{-4}$ Torr, as in Japanese Patent Application No. 135,866/1979 filed by the inventors of the present invention. As a result, the polarity of the Nesa film 52 is converted from strong $n^+$ to weak n. On a surface of this n-type Nesa film 52, a $p^+$layer 53 is deposited as follows.

First, ZnTe is deposited on the Nesa film 52 with a thickness of between 50 and 500 Å in an oxygen atmosphere. In this deposition, according to the method as disclosed in U.S. Ser. No. 213,016, the partial oxygen pressure is set at $1\times10^{-4}$ Torr, and the oxygen is activated by the electron beam or the like. ZnTe is deposited firstly with a thickness between 10 and 500 Å at a deposition velocity between 1 and 10 Å/sec, and then further deposited with a thickness between 10 and 500 Å at an increased deposition velocity between 50 and 100 Å/sec. As a result thereof, the Nesa film 52 is operated simply as a signal electrode, and the ZnTe film disposed close to the Nesa film 52 is operated as the $p^+$layer 53, whereby the injection of the electrons is blocked. The ZnTe film has a p-type polarity which becomes weaker as the film becomes remote from the Nesa film 52. This weak p-type film contained in the $p^+$type layer 53 is provided for weakening the strong electric field caused between the CdTe layer and the $p^+$-type layer by depositing CdTe on the surface of the $p^+$-type layer, which field is characterized spikes or humps. As a material of this $p^+$-type film 53, CdTe can be used, instead of ZnTe. However, CdTe presents larger light absorption than ZnTe, so that pure ZnTe is the most suitable. On the ZnTe film 53 formed as mentioned above, the p-type layer 54 consisting of CdTe and the n-type layer 55 consisting of CdS are deposited sucessively, as to form a photoconductive layer.

In the case of the HN system, the energy of the electron beam landing on the target becomes 100 to 1000eV, so that it is required to absorb the large energy. For this requirement, a block layer 56 is deposited on the n-type layer 55 according to the present invention. It is preferable to form the block layer 56 of CdTe, ZnTe, or a solid solution of these materials. The crystal structure of these materials is of the Wurtzite-type or zinc blende-type, so that these materials can bear the beam impact, and further, since the molecular weights of these materials are large, a 20 to 2000 Å thick layer thereof can absorb the high speed electron beam sufficiently. In addition, these materials have an advantage in that the resistance thereof can be arbitrarily adjusted in accordance with vacuity or residual gas for forming a deposition film.

Figure 14:
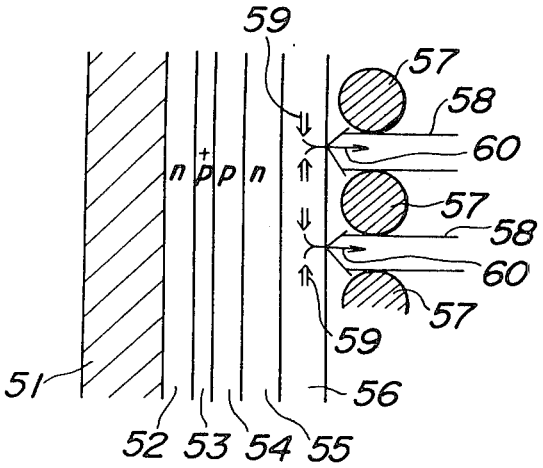
FIG. 14 is an enlarged partial sectional view showing the operation of the same.

In a camera tube of the HN type, as shown in FIG. 14, portions of the target which are shadowed by the mesh 57 are not impacted by the high speed beam 58, and hence secondary electrons are not emitted therefrom. Accordingly, it is necessary to derive the output signal by leaking signals accumulated in those shadowed portions along the surface of the block layer 56, namely, in the lateral direction as shown by arrows 59 and by emitting secondary electrons from the portions impacted by the electron beam 58. Thus, it is necessary also to form the block layer 56 of a material such that the high speed electron beam 58 is blocked, as well as the resistivity in the lateral direction is made appropriately low and further can be arbitrarily adjusted.

From the above necessities, the block layer 56 is formed by depositing ZnTe, CdTe or the solid solution thereof on the photoconductive layer in a hydrogen atmosphere having a hydrogen pressure of $1\times10^{-4}$ Torr.

The resistivity of the block layer 56 formed as mentioned above becomes between $10^8$ to $10^{13}$ Ωcm. When this deposition is effected, according to U.S. Ser. No. 213,016, in a hydrogen atmosphere formed by activating the hydrogen gas under the ionization effected by the electron beam, the reproducibility of the resistivity of the block layer 56 is further improved. In this situation, the desired resistivity can be obtained by setting the hydrogen pressure for the deposition at $1\times10^{-4}$ Torr and by varying the evaporation speed in a range of 1 to 100 Å/sec. For example, when the evaporation speed is less than 1 Å/sec, the resistivity becomes more than $10^{13}$ Ωcm, and, as a result, although the effect of blocking the electron beam can be obtained, the signal charge at the shadowed portion of the block layer 56 is not discharged and hence an afterimage is caused. On the other hand, when the evaporation speed is more than 100 Å/sec, the resistivity becomes too low, and, as a result, although the afterimage based on the shadowed portions of the block layer 56 can be removed, the leakage current becomes too large and hence the resolution is lowered. These results have been certified by an experiment. In this experiment, particularly the evaporation speed range of 10 to 50 Å/sec is the most suitable for obtaining such a block layer as the afterimage does not occur and the resolution is not lowered.

The material used for the target of the above mentioned type, that is, CdS, CdTe, ZnTe or the solid solutions thereof, has such a property that the evaporation thereof in the vacuum is effected by the sublimation from the solid state without the step of liquidation. When these sublimative materials are heated in an ordinary conical alumina basket, the material at the portion contacting the basket sublimates first, so that the material at the upper portion thereof is apt to be scattered by the gas pressure of the evaporated material. To prevent this scattering, an evaporating source of the upper radiation type in which the heater is arranged above the material to be evaporated and the variation thereof, that is, an evaporating source of the Drumheller type, namely, commonly called chimney type has been developed. However, the scattering of the evaporation material can not be completely prevented even by these improved evaporating sources, and particularly when the heater temperature is raised to increase the evaporation speed, this tendency is great. When powder materials such as CdS or the like, by which the infrared radiation can be hardly absorbed because of the wide forbidden band thereof, is employed, the inner portion of these materials is heated more than the surface portion thereof, and hence these materials are apt to be scattered. When the evaporation material is deposited on the target by the scattering thereof, the scattered and deposited material causes spikes on the reproduced picture, as well as often induces a short circuit based on the electric field concentration on the scattered and deposited material in the situation where the target and the metal mesh are disposed adjacent to each other according to the present invention. Moreover, the infrared radiation emitted from the heater heats the source support, which is usually formed of metal, through the evaporation material, so that the power of the heater cannot help being increased. As a result, the heater supporting members are unnecessarily heated and hence often release the gas therefrom, the purity of the atmosphere of the deposition, which is formed of oxygen, hydrogen or the like, is deteriorated, and hence the reproducibility of the deposition is deteriorated also. In addition thereto, the conventional evaporating source has a further defect in that the exchange of the evaporation material is somewhat complicated.

Figure 15A:
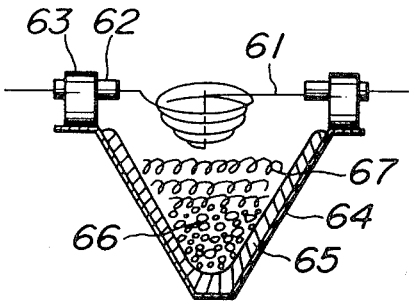
FIGS. 15A and 15B are a cross-sectional view and an enlarged partial diagram showing respectively an example of the arrangement of an evaporation source used for manufacturing the target of the same according to the invention.
Figure 15B:
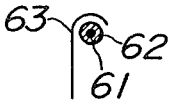

It is effective for removing the above-mentioned various defects of the conventional evaporating source to employ an evaporating source having such as structure as shown in FIGS. 15A and 15B. In these drawings, 61 is a conical-shaped spiral heater formed of tungsten wire or the like, both ends of which are covered by porcelain 62. 63 is a hook formed of nichrome, Kovar or tantalum, so that it can be suspended by the porcelain 62. A conical-shaped supporting vessel 64, which is formed by pressing a nickel, nichrome, Kovar or tantalum sheet, is hung on a hook 63. The inner wall of the vessel is covered with an electrically deposited thermal insulation film 65 of such a thermal insulation material as alumina, magnesia and zirconia. A sublimative deposition material consisting of CdS, CdTe, ZnTe or a solid solution thereof is held in this supporting vessel 64, which is filled with a heat resistive filter 67 formed of such a material as quartz cotton or tungsten mesh which can bear the high temperature. A heater 61 is arranged over the filter 67 in such a way that the top of the spirally constructed heater is directed downward.

When the deposition is carried out, the filter 67 is heated by the heater 61, and then the heated filter 67 heats the upper surface of the deposition material. This evaporating source is operated such that the heat is radiated downwards, so that the heat is scarcely scattered, and powders of the evaporation material are not scattered at all. In addition thereto, since the supporting vessel 64 is covered by the heat insulation material 65, the heat loss is low, and hence the heater power required is less than one half of that required for the above-mentioned conventional source. Accordingly, the heater supporting members are not unnecessarily heated and the release of gases therefrom is avoided.

Figure 16:
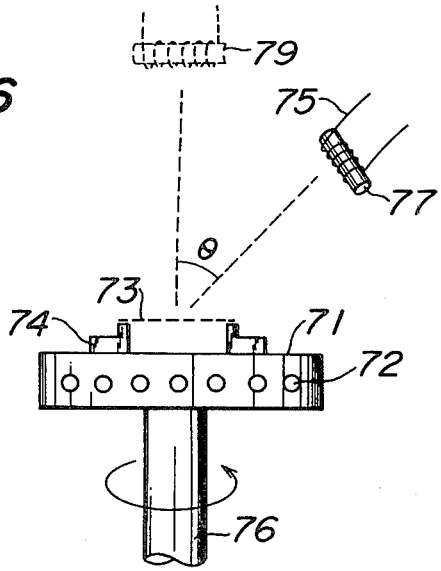
FIG. 16 is a diagram showing a method for insulating the mesh of the same.

Next, a method of the present invention for depositing the insulation material 25 on the metal mesh 24 as shown in FIG. 7 will be described by referring to FIG. 16. In FIG. 16, 71 is a rotating table, in which a heater 72 is buried. A metal mesh 73 is put on a supporting bed 74 of the rotating table 71. 75 is a supporting member for the evaporating source, for instance, a coil formed of tungsten, which is arranged such that it is tilted by an angle $\theta$ with respect to the axis of rotation of an 76 of the rotating table 71, and in which an evaporating source 77 provided as a block of an insulation material such as $MgF_2$, SiO, $Y_2O_5$ or a mixture thereof is accommodated. As the evaporating source 77, such a source as is shown in FIG. 15A or 15B can be used. Prior to the evaporation deposition, the metal mesh 73 is preheated by the heater 72 at 80° to 400° C. to assure that the insulation material is securely fixed on the metal mesh 73. Parenthetically, at a temperature below 80° C., it becomes impossible to effect the secure fixation of the insulation by heating, and, at a temperature exceeding 400° C., the insulation on the metal mesh 73 is ragged. Although only one coil 75 is sufficient, it is preferable for effecting uniform deposition to provide more than two coils 75. It is also preferable to set an angle $\theta$ of the coil 75 at 20 to 70 degrees. When the deposition is effected at the angle $\theta>70°$ or $\theta<20°$, the insulation material is deposited mostly on the upper surface of the metal mesh 73, while a small amount of the insulation material can be deposited on the side wall and the bottom thereof.

Figure 17A:
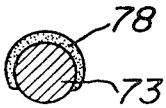
FIGS. 17A and 17B are diagrams showing two examples of insulation deposition of the mesh of the same respectively.
Figure 17B:
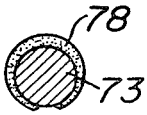

As mentioned above, the insulation material evaporated from the source 77 is deposited on the metal mesh 73 by heating the metal mesh 73 by the heater 72 and by rotating the axle 76 by a motor or by hand. It is preferable that the rotation speed of the axle 76 is set at a rate of one revolution each second or each ten seconds and the speed of deposition set at a rate of 1 to 1000 Å/sec, a deposition film having a thickness 1000 Å to 5 μm being obtained. When the thickness of the film is less than 1000 Å, insufficient insulation is provided, and when the thickness of the film exceeds 5 μm, clogging of the mesh occurs. The uneven surface of the metal mesh 73 is thoroughly covered by the insulation material according to the above rotation of the axle 76. It is insufficient for this deposition that the upper surface and the side surface of the mesh 73 is covered by the insulation material 78 as shown in FIG. 17A and it is required that almost all of the surface involving the bottom surface of the mesh 73 be covered by the insulation material 78 as shown in FIG. 17B. If the deposition of the insulation material 78 is not effected as mentioned above, when the camera tube provided with the insufficiently covered metal mesh 73 is operated, the secondary electrons emitted from the target are caught by the uncovered portion such as the side surface of the metal mesh 73, and, as a result, the secondary electrons $I_{T2}$ which can be collected by the collector electrode 28 as shown in FIG. 6 are reduced. The insulation material used for the above deposition can be selected from the group of $MgF_2$, SiO and $Y_2O_3$, and $MgF_2$ can be the most firmly deposited on a mesh 73 formed of copper. Accordingly, the insulation material is prevented from being mechanically peeled off during assembly of the camera tube, which will be described later. In addition, the insulation material can sufficiently withstand any impact caused by the assembly procedure.

Almost all of the surface including the rear surface of the metal mesh 73 is covered by the deposited insulation material, so that, for securing the electric conductivity of the rear side of the mesh 73, it is required that a conductive material be deposited only on the rear top portion of the mesh 73. In other words, when the rear surface of the mesh 73 is locally covered by the insulation material, the covered rear surface is charged by the scanning beam, and hence has a potential which is different from that on the remaining surfaces on which the copper is exposed. As a result, the irregular local variation of the mesh potential causes uneven collection of the secondary electrons to contaminate the basic surface of the mesh 73. Accordingly, after the above deposition of the insulation material, the mesh 73 is turned over to put the rear surface upwardly. In this situation, a small amount of gold is deposited on the mesh 73 by another evaporating source 79 which is arranged just above the mesh as shown by dotted lines in FIG. 16, preferably at $\theta=0°$, so that gold is deposited only on the top portion of the mesh 73 on the beam scanning side and hardly deposited on the side surfaces thereof. In this case of gold deposition, the mesh 73 is rotated by the rotating axle 76, and, as a result, the microscopic unevenness of the surface of the mesh 73 can be smoothed by this gold deposition. However, it is preferable for the gold deposition that heating by the heater 72 is not employed, because, when the mesh 73 is heated by the heater 72, the mesh 73 sags and hence the surface thereof facing the target is also covered by the deposited gold and, as a result, the insulation is inferior. In addition, it is also preferable that the gold evaporating source 79 be separated from the mesh 73 by more than 30 cm, so that the difference of the distances between the evaporating source 79 and the peripheral portion and the central portion of the mesh 73 is minimized, and, as a result, the gold vapor is incident perpendicularly to the entire portions of the mesh 73. It is suitable that the deposited gold layer has a thickness between 30 Å and 300 Å. When the thickness thereof is less than 30 Å, inferior electric conduction often results, while, when the thickness thereof is more than 300 Å, particles of gold are often deposited around the side surfaces of the mesh 73.

In the above situation, it is possible that a small amount of lumped particles of gold might be deposited on the surface of the mesh 73 on the side of the target, and hence the mesh 73 and the target would be short-circuited. To prevent this short circuit it is preferable that the mesh 73 is turned over again and an insulation material such as $MgF_2$, SiO, $Y_2O_3$ or the like is deposited again on the surface thereof facing the target. In this case, the evaporating source 77 is arranged at $\theta=0°$, so that the insulation material is deposited only on the top portions of the mesh 73 which face the target. It is suitable that the thickness of the deposited insulation layer is set at about 150 to 2000 Å. When this thickness is less than 150 Å, the insulation of the mesh surface is inferior, while, when this thickness is more than 2000 Å, the insulation material extends around the surfaces of the gold film previously deposited on the mesh 73, and this often causes insulation failure.

As mentioned above, the deterioration of the basic surface of the metal mesh can be prevented by depositing gold as a conductive material on the surface thereof exposed to the scanning beam, and, as a result, the irregular variation of the potential of the metal mesh in response to the variation of the portions thereof is removed, so that the surface potential on the beam scanning side of the mesh can be made uniform.

The same effect as mentioned above can be obtained also by depositing the blocking material used for the target itself of the HN type against the high speed scanning electron beam, that is, CdTe, ZnTe or a solid solution thereof as mentioned earlier on the surface of the metal mesh on the beam scanning side thereof. In this case, which is different from the case of gold being used as a conductive material, the electric resistivity obtained is high because of the semiconductor material.

However, this electric resistivity can be lowered by setting the hydrogen pressure at $1\times10^{-4}$ Torr and varying the evaporation speed in the range from 1 to 100 Å/sec as mentioned earlier. Further, in the case of gold, when the thickness thereof is more than 300 Å, a short circuit between the mesh and the target is often caused by gold particles covering the backside of the mesh, while, in the case that CdTe, ZnTe or a solid solution thereof is employed, the above turning round is scarcely caused, so that, even when the thickness of the deposited film thereof becomes about 20 to 2000 Å, a short circuit does not occur between the mesh and the target. Accordingly, in the case that CdTe, ZnTe or the solid solution is deposited on the mesh, the thickness thereof is not restricted so severely as in the case of gold, so that there is an advantage in that it is not necessary to turn over the mesh again to deposit an insulation material such as $MgF_2$, SiO, $Y_2O_3$ or the like on the other side of the mesh as mentioned above. In this case, no inconvenience occurs even when an insulation material such as $MgF_2$, SiO, $Y_2O_3$ or the like is deposited thereon again as mentioned above for safety, as a matter of course.

The metal mesh formed as mentioned above is covered by the insulation material on the side of the target, so that the mesh and the target are not short-circuited with each other at all theoretically even when they are in direct contact with each other. However, if a portion of the mesh is not completely insulated, there is the possibility of a short circuit. Once the short circuit occurs, the mesh is broken. Accordingly, it is necessary to ensure that the mesh and the target are not short-circuited at all. This requirement is met by inserting an extremely thin ring of insulation material as about 0.5 to 5 μm thick between the mesh and the target for maintaining a space therebetween.

In a conventional image orthicon, a spacer in the form of a metal ring having a thickness of about 5 to 30 μm is inserted between a mesh and a target thereof. However, such a metal ring cannot insulate the target from the mesh. Although it is conceivable to use a ceramic ring in place of the metal ring, it is impossible to reduce the thickness thereof to about 0.5 to 5 μm. On the other hand, although it is also conceivable to form the spacer by stamping out a mica sheet in form of ring, the periphery of the mica ring has minute projections, so-called naps, so that the thickness of the mica ring cannot be unified. As mentioned above, a spacer suitable for the above-mentioned camera tube cannot be obtained according to the conventional material and the conventional method. Consequently, according to the present invention, the required spacer is formed by deposition. Two examples thereof will be described by referring to FIGS. 18A and 18B and 19A and 19B.

Figure 18A:
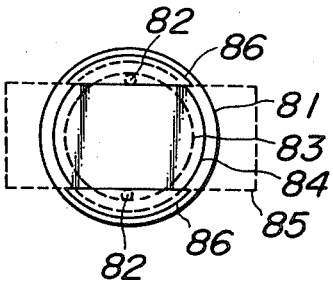
FIGS. 18A and 19A are plan views showing two examples of an insulation spacer inserted between the target and the mesh of the same respectively.
Figure 18B:
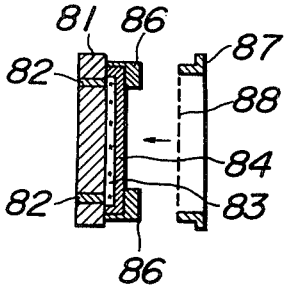
FIGS. 18B and 19B are cross-sectional views showing the two examples respectively.

In FIGS. 18A and 18B, 81 is a circular glass faceplate, in which a pin 82 formed of a metal wire such as Kovar has been previously buried in a flat-topped manner. This pin 82 is used for deriving the output signal from a signal electrode formed on the glass faceplate 81. A single pin 82 is enough. However, in order to check the electric resistance of a transparent electrode 83 it is desirable to provide two pins 82. The transparent electrode 83 is deposited on the faceplate 81 provided with the pin 82, for instance, by the CVD method. For this deposition, it is preferable that a reinforcing electrode be provided on the surface of the pin 82, so as to improve the contact with the transparent electrode 83, by utilizing the teachings of the above-described Japanese Patent Application No. 135,866/1979. A target 84 is deposited on the transparent electrode 83 such that the transparent electrode 83 is thoroughly covered. That is, for this deposition, the target is deposited over an area which is wider than that of the transparent electrode 83, and, as a result, the portions of the transparent electrode 83 and the pin 82 are not exposed on the peripheral portion of the faceplate 81.

This measure is effected for preventing a mesh 88 as mentioned later from being short-circuited to the exposed transparent electrode 83 and the exposed pin 82 and that a part of the secondary electrons, which have impacted the mesh 88 or an indium ring as mentioned later by referring to FIG. 20, flows directly into those exposed portions. A mask 85 as shown in FIG. 18A is used for depositing two, three or more crescent insulation spacers 86 on the surface of the target 84, and, as shown by an arrow in FIG. 18B, a mesh 88 stretched on a fixing ring 87 is fixed thereon. The material of the insulation spacer 86 can be selected from the group of SiO, $MgF_2$, $Y_2O_3$ and the line. This material is deposited on the target 84 with a thickness of about 0.5 to 5 μm by evaporation in a vacuum which is less than $1\times10^{-3}$ Torr, and, as a result, the insulating spacer 86 for forming a space 0.5 to 5 μm between the target 84 and the mesh 88 can be obtained. When the space is less than 0.5 μm, the target 84 and the mesh 88 contact each other through minute projections thereof or by the electrostatically absorbing force therebetween, so that the spacer 86 does not not work as a spacer. If the space is more than 5 μm, the resolution is apt to be lowered by the spurious signal by redistribution. It is preferable that the insulation spacer 86, as shown in FIG. 13A, be formed of two crescents which are arranged opposite to each other in a direction perpendicular to a line connecting the two pins 82. This is because it is favorable that, since the raster has a rectangular shape having longer transverse sides, the beam scanning area, namely, the effective area is set as large as possible. The space between the target 84 and the mesh 88 can be held uniformly in a range from 0.5 μm to 5 μm by forming the insulation spacer 86 through the evaporation thereof. Moreover, in this case, such advantages can be obtained that mechanical damage, as in the case when the insulating ring is inserted therebetween from the outside, is not caused at all and that insulation spacers having various dielectrics can be formed by changing the insulation materials to be evaporated.

Figure 19A:
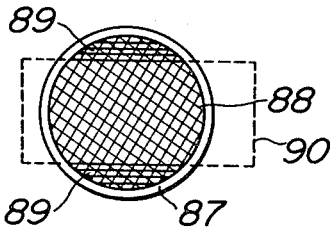
Figure 19B:
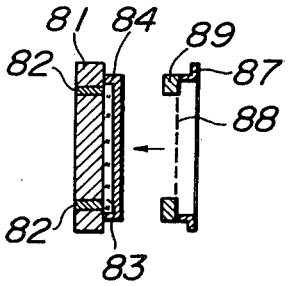

Although the insulation spacer is deposited on the target in the examples shown in FIGS. 18A and 18B, the mesh, on which the insulation spacer has been previously deposited, may be fixed to the target. This example is shown in FIGS. 19A and 19B in which the same parts are indicated by the same numerals respectively as im FIGS. 18A and 18B. In FIGS. 19A and 19B, 89 is an insulation spacer deposited on the mesh 88. Two crescent spacers 89 are deposited, as shown in FIG. 19A, on the surface of the mesh 88 which is stretched on a fixing ring 87 on the side thereof facing the target. The evaporation material and the thickness thereof are the same as shown in FIGS. 18A and 18B, and the situation where chords of the two crescent spacers 89 that are opposite to each other are arranged perpendicular to the vertical direction of the raster is also just the same as shown in FIGS. 18A and 18B. Further, the mesh 88 is arranged in such a way that individual sections thereof can be scanned by the electron beam along the diagonal direction, and hence the mesh beat caused by the scanning beam does not appear. By the way, it is naturally possible that the insulation spacer 86 as shown in FIGS. 18A and 18B is deposited on the target 84 and the insulation spacer 89 as shown in FIGS. 19A and 19B is deposited on the mesh 88, and further both spacers 86 and 89 are secured to each other.

Figure 20:
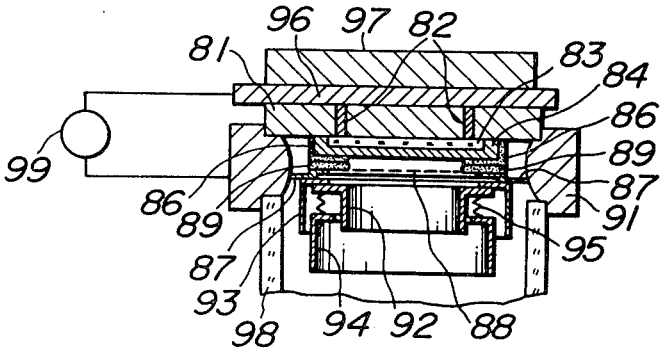
FIG. 20 is a cross-sectional view showing a method of manufacturing the TV camera tube according to the present invention.

Next, according to the present invention, the target and the mesh with the electron gun in the camera tube is assembled as shown in FIG. 20. That is, the case that the target and the mesh are assembled with an electron gun available on the market, for instance, of the separated mesh type used for the LP system will be described. In FIG. 20, the same parts as those in FIGS. 18A and 18B or in FIGS. 19A and 19B are indicated by the same numerals. Further, in FIG. 20, the indium ring 91 is used for vacuum-sealing the envelope of the camera tube and is operated as an electrode for applying the voltage to the mesh 88 by being contacted to the fixing ring 87 fixed on the peripheral portion of the mesh 88. 92 is a mesh rack for disposing the mesh 98 thereon through a Teflon ring 93. The mesh 88 is fixed on the $G_4$ electrode 94 in the conventional camera tube of the LP type, while the Teflon ring 93 having a thickness of 0.1 to 0.8 mm is used for insulating the mesh 88 from the $G_4$ electrode 94. The Teflon ring 93 has a skirt portion on the periphery thereof for preventing the indium ring 91 from electrically contacting the mesh rack 92 and a spring 95. That is, the mesh rack 92 is arranged such that it always have applied thereto an upwards defecting force by the spring 95 provided between the $G_4$ electrode 94 and the mesh rack 92 itself, whereby the mesh 88 is always pushed against the faceplate 81. Even if the distance between the $G_4$ electrode 94 and the faceplate 81 is varied, for instance, by the heat expansion caused during the operation of the camera tube, the mesh 88 can be prevented from separating from the target 84, so that the distance between the mesh 88 and the target 84 can be held at a constant amount. Furthermore, 96 denotes a conductive gum sheet for deriving the signal from the pin 82 of the faceplate 81, 97 a metal holder for holding the faceplate which is mounted on the outer side of the gum sheet 96 in a manner which is electrically insulated from ground, and 98 a glass envelope surrounding the $G_4$ electrode 94. 99 is a capacitance meter used while assembling the camera tube according to the present invention. The meter 99 is connected between the conductive gum sheet 96 and the indium ring 91 to measure the capacitance therebetween.

In the present invention, when assembling the camera tube, first the mesh rack 92 is disposed on the $G_4$ electrode 94 through the spring 95, and then is covered by the Teflon ring 93, on which the mesh 88 is disposed, as well as the indium ring 91 is disposed on an opening end of the glass envelope 98. In this state, the indium ring 91 is not yet crushed and hence is not yet contacted with the mesh 88. Next, the indium ring 91 is crushed downwards by the faceplate 81 absorbed, for instance, through the vacuum chuck, whereby the faceplate 81 and the glass envelope 98 are vacuum-sealed therebetween, as well as a mesh fixing ring 87 is contacted with the crushed indium ring by pushing it thereinto. In this procedure, the conductive gum sheet 96 disposed upon the faceplate 81 is crushed by being contacted with the pin 82, and further the capacitance meter 99 is connected between the gum sheet 96 and the indium ring 91 so that the capacitance between the transparent electrode 83 and the indium ring 91 through the mesh 88 can be measured.

In the above process for crushing the indium ring 91, in a state that the indium ring 91 and the mesh 88 do not contact each other yet, the capacitance meter 99 indicates a capacitance of about 20 pF for the one inch type target. Next, at the instant that the indium ring 91 and the mesh 88 come into contact with each other, the capacitance therebetween increases abruptly, and hence the capacitance meter 99 indicates about 2000 pF. At this instant, the procedure of pushing the indium ring 91 is finished. As mentioned above, the vacuum sealing caused by the indium ring 91 is effected by setting up the standard of the variation of capacitance between the indium ring 91 and the mesh 88, so that the conatct between the indium ring 91 and the mesh 88 can be confirmed, as well as the mesh 88 can be prevented from the deformation thereof caused by the excessive large pressure applied to the peripheral portion of the mesh 88 by the crushed indium ring 91.

In the above vacuum sealing procedure, when the faceplate 81 is directly pressed by the faceplate holder 97 absorbed, for instance, by the vacuum chuck, a large amount of distortion is caused on the portions of the pin 82, so that it is feared that the faceplate 81 is broken. Accordingly, in this situation, the above-mentioned conductive gum sheet 96 is inserted between the faceplate 81 and the faceplate holder 97, and hence the pressure caused from the faceplate 97 is uniformly applied to the faceplate 81, whereby the faceplate 81 can be prevented from being damaged.

After the vacuum sealing has been completed, the capacitance between the pin 82 and the indium ring 91 becomes about 2000 pF in the case of one inch type target, and the capacitance between the indium ring 91 and the $G_4$ electrode 94 becomes a few pF. The latter capacitance can be reduced to as small a value as possible by increasing the thickness of the Teflon ring 93. However, it is usually preferable to select the thickness of the Teflon ring 93 at about 0.1 to 0.8 mm.

As is apparent from the above, according to the present invention, the following various advantageous effects can be obtained.

(1) The side of the metal mesh which faces the target is covered by the evaporated insulation material, so that secondary electrons emitted from the target are collected by the collector electrode without being captured by the metal mesh and as a result the signal current hardly leaks to the metal mesh. Besides, this effect can be obtained just by depositing the insulation material on the metal mesh from a direction inclined with respect to the metal mesh, so that the manufacturing process is simple and easy.

In addition, the mesh potential is uniform over the entire surface of the metal mesh by depositing gold on the side of the metal mesh which is scanned by the electron beam after the above-mentioned evaporation of the insulation material, and further, if necessary, the surface of the metal mesh which faces the target is completely insulated by depositing insulation material on the metal mesh from the evaporating source disposed vertically above the metal mesh after the evaporation deposition of gold.

(2) The target of the HN type can be easily obtained only by forming the $p^+$type electron blocking layer on the usual n type transparent electrode layer under the evaporation of ZnTe in the oxygen atmosphere and further by depositing the p-n type photoconductive layer which has a reverse polarity to that of the LP type and then the $n^+$type block layer on the surface of the electron blocking layer. In addition, when manufacturing the target, the distance between the metal mesh and the target can be made as narrow as possible, so that the grounded stray capacitance of the target can be reduced also, and, as a result, generation of the spurious signal by redistribution can be completely prevented.

(3) For effecting evaporation of the target, particles of CdS, CdTe, ZnTe or the solid solution thereof are evaporated from the upperside thereof through the filter in the form of heated quartz cotton, tungsten mesh or the like, so that the particles do not scatter. Accordingly, a uniform and faultless target can be obtained and hence a short circuit between the target and the metal mesh can be completely prevented.

(4) For the deposition of the target, particles of CdS, CdTe, ZnTe or the solid solution thereof is accommodated in the heat-insulated supporting vessel, and hence the loss of heat is prevented to the utmost, so that the gas generated from the tools during heating is greatly reduced and hence the deterioration caused by the gas is also reduced, and, as a result, the target can be formed with excellent reproducibility.

(5) A camera tube of the HN type can easily be manufactured in a manner substantially similar to that of the usual LP type by assembling the HN type target and the metal mesh in an electron gun available on the market for the usual LP system by employing the pinned faceplate, Teflon ring, conductive gum sheet and the like and then by effecting vacuum sealing by the indium ring.

For this assembly, the conductive rubber sheet is inserted between the glass faceplate and the faceplate holder, so that the impact by the pressure applied to the faceplate holder is absorbed by the rubber sheet and hence is transmitted uniformly over the whole area of the glass faceplate. In this way, the glass faceplate is sufficiently protected. In addition, whether the crushed indium ring contacts the metal mesh or not is confirmed by the capacitance meter connected between the rubber sheet and the indium rings, so that without the necessity of great skill crushing of the indium ring by excessive pressure and consequently the application of excessive pressure to the outer peripheral portions of the metal mesh with consequent deformation of the metal mesh is avoided.

(6) In this way, the present invention has the advantage of providing a method of manufacturing a camera tube which has all of advantages to be expected from a camera tube of the HN type; the capacitive discharge lag performance is excellent, the resolution performance is excellent, especially in the peripheral portion and beam bending does not occur at all. In addition, the camera tube has the further advantages that the SN ratio is preferable, the spurious signal by redistribution is removed and the dark current is reduced, so that all of defects of the conventional camera tube the HN type are removed. The excellent camera tube as mentioned above can be manufactured by easily utilizing the manufacturing technique for a conventional target of the LP type and the assembling technique of a camera tube.

What is claimed is:

1. In a method of manufacturing a camera tube, said camera tube comprising an envelope containing a glass faceplate and an electron gun including a cathode; an n-type transparent electrode layer; a photoconductive target formed on said n-type transparent electrode, said target being composed at least of a photoconductive layer formed by depositing a thin $p^+$-type layer, a p-type layer and an n-type layer in succession on said n-type transparent electrode layer; and a block layer formed on said photoconductive layer for blocking an electron beam emitted from said cathode from passing through said photoconductive layer; a metal mesh disposed in the vicinity of a side of said photoconductive target, said side being scanned by said electron beam; and a collector electrode disposed between said metal mesh and said cathode for collecting secondary electrons emitted from said photoconductive target, whereby said photoconductive target is scanned by said electron beam emitted from said cathode, the steps of:

heating said metal mesh at a temperature in a range from 80° C. to 400° C.;

rotating the heated metal mesh around a rotation axis which is perpendicular to the surface of said metal mesh at a rate in the range of one revolution per second to ten revolutions per second;

depositing an insulation material on a surface of said metal mesh from an evaporating source disposed above said metal mesh at an angle in a range from 20 degrees to 70 degrees to form an insulated metal mesh; and disposing the surface of said insulated metal mesh which is completely covered by the insulation material opposite to said photoconductive target.

2. A method of manufacturing a camera tube as claimed in claim 1, wherein said insulation material is selected from the group consisting of SiO, $MgF_2$ and $Y_2O_3$, the thickness of the deposited insulation material being in the range from 1000 Å to 5 μm.

3. A method of manufacturing a camera tube as claimed in claim 1, which comprises the further step of depositing one of a conductive material and a semiconductive material on the surface of said insulated metal mesh which is not completely covered by said insulation material from an evaporating source disposed vertically above said metal mesh.

4. A method of manufacturing a camera tube as claimed in claim 3, wherein said conductive material consists of gold, and the thickness of the deposited gold is in the range from 30 Å to 300 Å.

5. A method of manufacturing a camera tube as claimed in claim 3, wherein, after the deposition of gold, the surface of said insulated metal mesh which is not completely covered by said insulation material is covered by said insulation material with a thickness in a range from 150 Å to 2000 Å, said insulation material being evaporated from an evaporating source disposed vertically above said metal mesh.

6. A method of manufacturing a camera tube as claimed in claim 1, wherein an insulating spacer for providing a space between said block layer and said metal mesh is deposited on at least one of said block layer and said metal mesh.

7. A method of manufacturing a camera tube as claimed in claim 6, wherein said insulating spacer is formed by a material selected from the group consisting of SiO, $MgF_2$ and $Y_2O_3$, and the thickness of said insulating spacer is in the range from 0.5 μm to 5 μm.

8. A method of manufacturing a camera tube as claimed in claim 1, wherein said photoconductive target is formed by said n-type transparent electrode layer in the form of a Nesa film, said $p^+$-type layer is formed by ZnTe or CdTe, said p-type layer is made of CdTe, said n-type layer is made of CdS and said block layer is formed by depositing CdTe, ZnTe or a solid solution thereof.

9. A method of manufacturing a camera tube as claimed in claim 8, wherein, in the steps of forming by deposition said photoconductive target and depositing an insulation material on said metal mesh, the material for forming said photoconductive target and the insulation material to be deposited on said metal mesh is accommodated in a conical vessel of either one of nichrome, Kovar, tantalum and nickel, an inner surface of which is heat-insulated by a film of either one of alumina, magnesia and zirconia, and said evaporation material is covered by a heat-resistive filter consisting of quartz cotton or tungsten mesh and then is heated by a tungsten heater disposed above said heat-resisting filter.

10. A method of manufacturing a camera tube as claimed in claim 1, wherein a pin to be connected to said n-type transparent electrode layer is buried in said glass faceplate; a mesh rack is disposed on said collector electrode and is covered by a skirted Teflon ring having a thickness in a range from 0.1 mm to 0.8 mm, said metal mesh being disposed on said Teflon ring; an indium ring is disposed on an opening end of a glass envelope surrounding said collector electrode; a peripheral portion of said glass faceplate belonging to a block consisting of said glass faceplate; said n-type transparent electrode layer and said photoconductive target are disposed on or opposite to said indium ring so that said block is opposite to said metal mesh; a faceplate holder is disposed on said glass faceplate via a conductive rubber sheet; and a capacitance meter is connected between said indium ring and said conductive rubber sheet for measuring the capacitance between said indium ring and said metal mesh; under this condition of measuring said capacitance, said glass faceplate being pressed towards said metal mesh by pushing down said faceplate holder to crush said indium ring; and, when the capacitance measured by said capacitance meter is suddenly increased, said faceplate holder is not pushed further, thereby causing the contact between an inner surface of the crushed indium ring and said metal mesh to be completed.

* * * * *